United States Patent [19]

Lane

[11] Patent Number: 4,956,883

[45] Date of Patent: Sep. 18, 1990

[54] SHOWER FIXTURE

[76] Inventor: Dale Lane, 4411 Marsh Rd., Marietta, Ga. 30066

[21] Appl. No.: 428,996

[22] Filed: Oct. 30, 1989

[51] Int. Cl.[5] ..... A47K 3/22

[52] U.S. Cl. ..... 4/605; 4/597; 4/601; 4/615; 4/628; 239/310; 239/379; 239/418

[58] Field of Search ..... 4/597, 605, 596, 601, 4/602, 604, 606, 615, 617, 559, 567, 628; 239/10, 310, 379, 418

[56] References Cited

U.S. PATENT DOCUMENTS

| | | | |
|---|---|---|---|
| 299,850 | 2/1989 | Feher et al. | D23/229 |
| 2,588,255 | 3/1952 | Larsh | 299/84 |
| 2,891,732 | 6/1959 | Orter et al. | 239/322 |
| 3,079,093 | 2/1963 | Bellows | 239/310 X |
| 3,083,915 | 4/1963 | Grouel | 239/379 |
| 3,106,345 | 10/1963 | Wukowitz | 239/310 |
| 3,112,073 | 11/1963 | Larson et al. | 239/446 |
| 3,198,437 | 8/1965 | Faglie | 239/418 X |
| 3,409,230 | 11/1968 | Eelkema | 4/605 X |
| 3,813,072 | 5/1974 | Moore | 4/605 X |
| 3,907,203 | 9/1975 | Skillings | 239/418 X |
| 4,131,232 | 12/1978 | Pollinzi | 239/379 X |
| 4,189,100 | 2/1980 | Karp | 239/310 |

*Primary Examiner*—Henry K. Artis

*Attorney, Agent, or Firm*—Thomas & Kennedy

[57] ABSTRACT

Apparatus is disclosed for dispensing liquid soap into or adjacent to a water stream emitted from a primary shower head mounted to a water line of a selected size. The apparatus has an auxiliary shower head from which a branch line extends of a size smaller than the water line size. It also has a mount for mounting the auxiliary shower head adjacent to the primary shower head with the branch line in fluid communication with the water line. A liquid soap reservoir is mounted in valved fluid communication with the auxiliary shower head.

10 Claims, 2 Drawing Sheets

SHOWER FIXTURE

TECHNICAL FIELD

This invention relates generally to shower fixtures, and particularly to shower fixtures used for personal washing of the body with liquid soap.

BACKGROUND OF THE INVENTION

Bathroom showers today almost inevitably emit only a stream of water with soap used in the hard cake or bar form. In a few environments a supply of liquid soap is provided in shower stalls rather than as a bar. In those situations a bottle of the liquid soap is typically mounted to a shower wall in an inverted orientation in association with hand operated valve means for dispensing soap from the bottle in spurts.

Heretofore situations have been recognized where it would be desirable to have liquid soap in the stream of water from the shower head itself, or at least in close proximity thereto. Representative of prior art devices thought to be usable as such are illustrated in U.S. Pat. Nos. 2,588,255 and 2,891,732. In the first of these patents liquid soap is gravitated from a container directly into the water line through which water is channeled to the shower head. This type of arrangement however functions very poorly due to the back pressure developed by the set of nozzle-like, restrictive openings in the shower head. This back pressure impedes the flow of liquid soap by gravity from its reservoir into the water line. Indeed, such can actually cause water to flow up into and flood the liquid soap supply reservoir. The device shown in the secondly mentioned patent provides a secondary flow of water taken off from the water supply line to the shower head which secondary flow is directed about a compressible bottle of liquid soap in a manner to squeeze and thereby force liquid soap out of the bottle and form a stream located beneath the main shower stream. This arrangement however results in the emission of three distinct streams, i.e. two water streams and one undiluted soap stream, with fully half of the water supplied to the shower head diverted to perform work merely in squeezing the compressible bottle of liquid soap. Such produces obvious waste and an adversely noticeable drop in main shower stream pressure.

Accordingly, it is seen that were a shower fixture to be devised which could be readily mounted to existing fixtures and effectively used in dispensing liquid soap into or at least adjacent to a shower stream in an effective and efficient manner, while overcoming the problem of back pressure, a distinct advance in the art would be achieved. It is to the provision of such therefore that the present invention is primarily directed.

SUMMARY OF THE INVENTION

In a preferred form of the invention, apparatus is provided for dispensing liquid soap into or closely adjacent to a water stream emitted from a primary shower head mounted to a water line of a selected size. The apparatus comprises an auxiliary shower head from which a branch line extends that is of a size smaller than the water line size. The apparatus includes means for mounting the auxiliary shower head adjacent to the primary shower head with the branch line placed in fluid communications with the water line. A liquid soap reservoir is mounted in valved, fluid communication with the auxiliary shower head.

In another form of the invention a shower fixture comprises a primary shower head and auxiliary shower head with each head adapted to be mounted to a common water line. The auxiliary shower head has an intake conduit that is smaller than that of the primary shower head. A liquid soap reservoir is mounted above the auxiliary shower head in fluid communication therewith.

DETAILED DESCRIPTION

Figure 1:
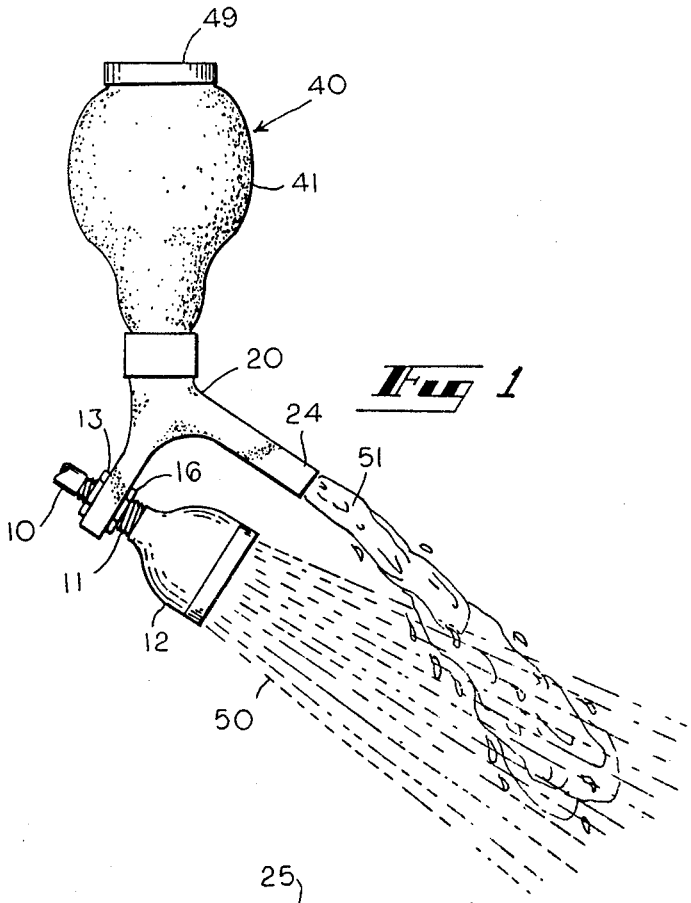
FIG. 1 is a side elevational view of apparatus that embodies principles of the invention in a preferred form.

With reference now in detail to the drawing, there is shown a conventional water line, conduit or pipe 10, hereinafter referred only to as "water line", to an end of which a coupling 11 is threaded. A conventional shower head 12, hereinafter termed primary shower head, is threaded onto an end of the coupling 11 located distally from the water line 10. A mount 20, having a passageway therethrough defined by an internal wall or bore 21 sized to be slid over the coupling 11, is so mounted to the coupling and butted up against a coupling flange 13. This is done with a branch line 22 inside the mount angularly aligned with an aperture 17 in the coupling. A lock nut 16 is then threaded onto the coupling 11 and run up against the mount 20 thereby securing the mount 20 firmly to the coupling. The primary shower head 12 is then threaded onto the other end of the coupling with the size of its intake conduit inside diameter denoted at C after threaded onto the coupling 11.

Figure 2:
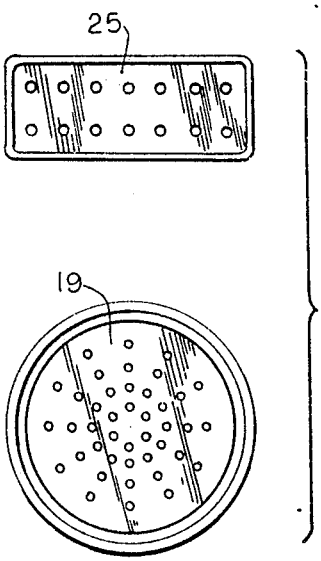
FIG. 2 is front face views of the two shower heads of the apparatus illustrated in FIG. 1.

The branch line 22 in the mount 20 extends from the internal mount wall 21 to an auxiliary shower head 24 that is formed unitarily with the mount. A multi-hole face plate 25 is mounted onto an open end of the shower head 24. Similarly, the primary shower head has a multi-hole face plate 19 is threaded onto an open end of the primary shower head 12. The faces of these two plates are shown in FIG. 2, each having an array of spray holes therethrough.

The upper end of the mount 20 is formed with a cup shaped, open top cavity defined by a flat floor 26 and a cylindrical side wall 27. An annular socket 28 is formed in the mount top surface 29 about the cavity. A soap supply line or conduit 30 extends from the cavity floor 26 to the auxiliary shower head 24.

The apparatus further includes a liquid soap reservoir or bottle 40 having a bulbous side wall 41 that extends from a planar wall or floor 42 to an access opening in its upper end which is closed by a cap 49. An annular flange 43 is formed along the outside periphery of the bottom wall 42 so as to project downwardly therefrom. A projection 44 with a channel 46 through both it and the bottom wall 42, also extends downwardly from the bottom wall 42 closely adjacent to the annular flange 43 offset from the center of the bottom wall. An arcuate lip 45 similarly projects downwardly from the wall 42 about the projection 44. The flange, projection and lip collectively form an annular recess in which an O-ring 47 is seated.

The bulbous side wall of the reservoir 40 in the region adjacent to the bottom wall 42 is cylindrical with an outside diameter that closely approximates the inside diameter of the cup shaped cavity of the mount 20. Thus the reservoir may be nested uprightly within the cavity for free rotation therein. For additional stability the reservoir 40 is formed with an annular ring or tongue 48 which is rotatably seated within an annular socket 28.

For use the reservoir 40, containing a supply of liquid soap, is rotated to align its channel 46 in its bottom wall 42 with the end of the soap supply line 30 in the bottom wall 26 of the mount cavity. Liquid soap may then gravitate from the reservoir 40 through the soap line 30 and into the auxiliary shower head 24. Thus, by rotating the bottle to this rotary position the soap line is effectively valved open. With unshown bathroom shower valves open allowing water to flow through water line 10, the majority of the water flows conventionally into the shower head 12 and out of the holes in its face plate 19. Simultaneously, a minority of the water flows upwardly through the branch line 22 in the mount 20 and into the auxiliary shower head 24 where it is mixed with liquid soap that as it enters the auxiliary shower head from soap supply line 30. From here the liquid soap, now diluted with water flowing to the auxiliary shower head, is emitted through the holes in the face plate 25. In this manner, as shown best in FIG. 1, a water stream 50 is emitted from the primary shower head 12 while a water diluted stream 51 of liquid soap is emitted from the auxiliary shower head 24 above the stream 50. Since the stream 51 has less pressure than the stream 50 it gravitates into the stream 50, as illustrated, and becomes entrained therewith. For rinsing the reservoir 40 is simply rotated thereby valving closed the soap supply line 30.

Figure 3:
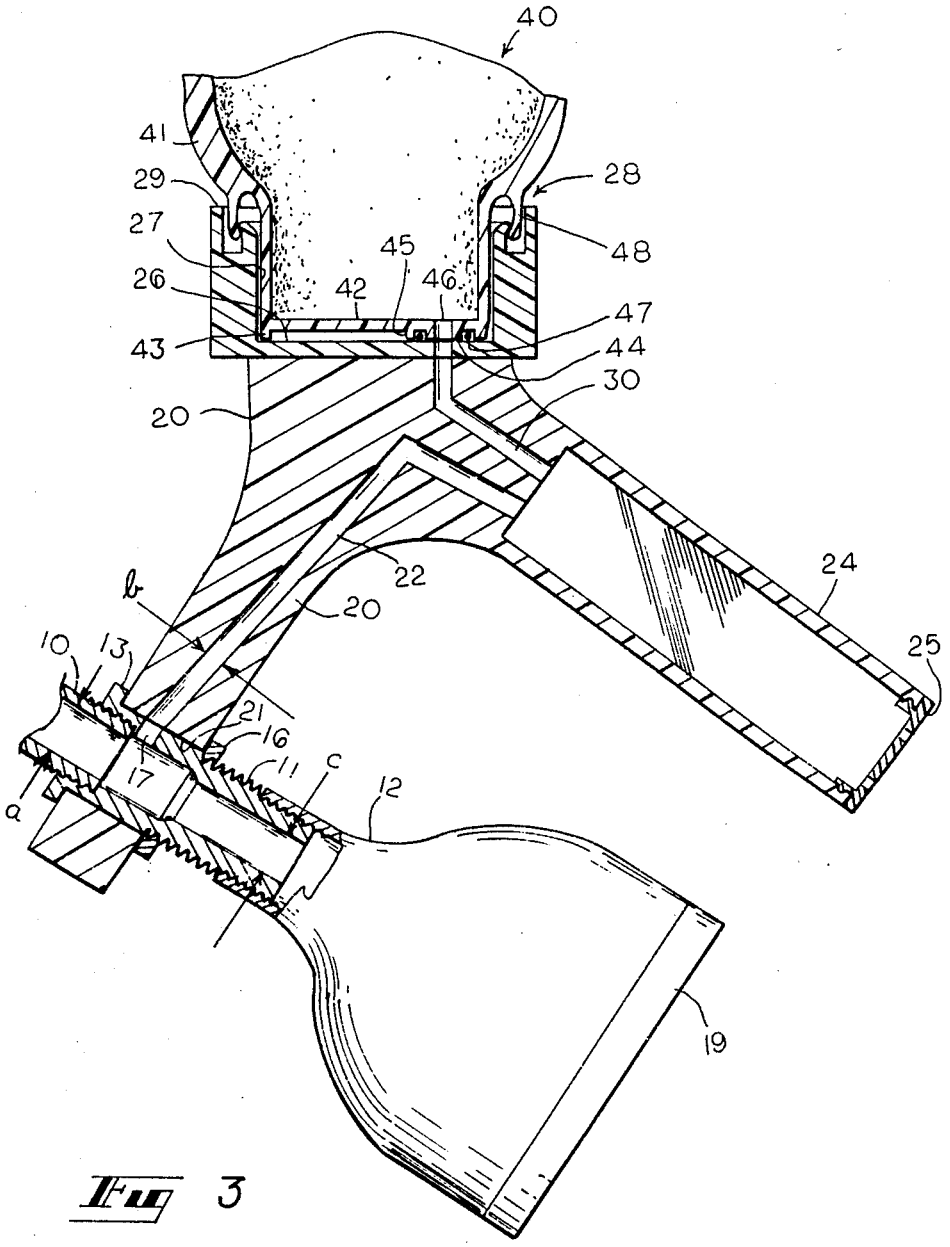
FIG. 3 is a side view, shown partly in cross section, of the apparatus illustrated in FIG. 1.

The just described apparatus has been found to overcome the problems of back pressure that previous devices of this sort have suffered. It has been found that the branch line 22 should have a size that is smaller than the primary shower head intake In other words, the diameter indicated at a in FIG. 3 should be larger than the diameter of the branch line indicated at b. It has also been found that the cumulative size of the spray holes in the plate 25 of the auxiliary shower head 24 should be equal to or greater than the cumulative size of the holes in the plate 19 of the primary shower head. When these conditions are met the back pressure developed in the auxiliary shower head is insufficient to cause water to block the flow of liquid soap out of the reservoir 40.

Where a is ½ inch diameter, a common size today, b ideally has been found to be ⅛ inch in diameter. Where b is ¼ inch diameter instead the apparatus has been found to be still workable yet not as well since pressure in the primary shower head and stream is too low. Conversely, where b has been made to equal a, e.g. both are ½ inch inside diameter, back pressure begins to become a problem. Where b is much smaller than even ¼ inch there is insufficient flow of the diluted soapy solution into the main stream.

It thus is seen that apparatus is now provided for entraining liquid soap with or providing an auxiliary stream of liquid soap closely adjacent to a water stream emitted from a conventional shower head which overcomes problems long associated with those of the prior art. It should be understood however that the just described embodiment merely illustrates principles of the invention in a preferred form. Many modifications, additions and deletions may be made thereto without departure from the spirit and scope of the invention as set forth in the following claims.

What is claimed:

1. Apparatus for dispensing liquid soap into or adjacent to a water stream emitted from a primary shower head mounted to a water line of a selected size, and with the apparatus comprising an auxiliary shower head from which a branch line extends of a size smaller than the water line size; means for mounting said auxiliary shower head adjacent to the primary shower head with said branch line in fluid communication with the water line, and a liquid soap reservoir mounted in valved fluid communication with said auxiliary shower head.

2. The apparatus of claim 1 wherein the primary shower head has a set of holes of a selected cumulative primary size, and wherein said auxiliary shower head has a set of holes of a selected cumulative auxiliary size equal to or greater than said primary set of holes cumulative size.

3. The apparatus of claim 1 wherein said mounting means comprises means for mounting said auxiliary shower head above the primary shower head whereby liquid soap emitted from said auxiliary shower head may gravitate into and become entrained with a water stream emitted from the primary shower head.

4. The apparatus of claim 1 wherein said mounting means includes means for mounting said liquid soap reservoir to said auxiliary shower head.

5. The apparatus of claim 4 wherein said mounting means has an open top cavity in which a bottom portion of said liquid soap reservoir is rotatably seated.

6. The apparatus of claim 5 having a soap line that extends from the bottom of said cavity to said auxiliary shower head and said liquid soap reservoir bottom portion has a hole located for alignment with an end of said mounting means soap line in one rotary position of said soap reservoir with respect to said mounting means cavity to establish valved open fluid communication between said soap reservoir and said auxiliary shower head at said one rotary position.

7. A shower fixture comprising an elongated, tubular coupling having internal threads at one end adapted to be threaded onto a water line, external threads at an opposite end and a side opening between said two ends; a primary shower head threaded onto said coupling external threads; an auxiliary shower head mounted on said coupling in fluid communication with said coupling side opening, and a liquid soap reservoir mounted above said auxiliary shower head in valved fluid communication therewith.

8. The shower fixture of claim 7 wherein fluid communication between said auxiliary shower head and said coupling is established by a branch line of a size less than the size of the water line.

9. The shower fixture of claim 7 wherein said auxiliary shower head and said primary shower head each have a set of spray holes with the cumulative size of the said auxiliary shower head spray holes being smaller than the cumulative size of said primary shower head spray holes.

10. A shower fixture comprising a primary shower head having a set of holes of a selected primary cumulative size, an auxiliary shower head having a set of holes of a selected cumulative size as large as or greater than said primary cumulative size, means for mounting said primary shower head and said auxiliary shower head to a water line in fluid communication therewith, and a liquid soap reservoir mounted above said auxiliary shower head in fluid communication therewith.

* * * * *